United States Patent [19]

Albrecht

[11] 3,960,146

[45] June 1, 1976

[54] TRACTION BELT

[76] Inventor: Donald Albrecht, P.O. Box 1406, 831 Second St., Santa Monica, Calif. 90406

[22] Filed: Mar. 3, 1975

[21] Appl. No.: 554,644

[52] U.S. Cl. ..... 128/75
[51] Int. Cl.[2] ..... A61H 1/02
[58] Field of Search ..... 128/75, DIG. 15, 78, 128/95, 84, 83, 149

[56] References Cited

UNITED STATES PATENTS

| | | | |
|---|---|---|---|
| 1,389,525 | 8/1921 | Mosby | 128/85 |
| 3,522,802 | 8/1970 | Morton | 128/75 |
| 3,561,434 | 2/1971 | Kilbey | 128/75 |
| 3,587,570 | 6/1971 | Kilbey | 128/75 |
| 3,618,598 | 11/1971 | Davis | 128/166 |

*Primary Examiner*—John D. Yasko
*Attorney, Agent, or Firm*—Donald D. Mon

[57] ABSTRACT

A traction belt for pelvic traction. It includes an encircling element adapted to be fastened around the patient, and has a pull-strap depending from the rear thereof. The pull-strap includes a pair of flexible arms joined to the encircling element at spaced-apart points relative to the spine of the patient. The arms are continuous with one another and support a connector link which is slidable along the pull-strap to define the length of the arms when pulled by traction force exerted upwardly and away from the patient. According to a preferred feature of the invention, a friction-reducing element is disposed at the back of the belt where it will reduce the sliding friction between the patient and the bed.

11 Claims, 7 Drawing Figures

TRACTION BELT

This invention relates to a traction belt for use in the application of pelvic traction force to a reclining patient.

The application of pelvic traction force to a patient is well known. It is customary to apply a belt to the patient and then, with his head or body otherwise restrained, to pull the belt in the direction of his feet so as to apply the traction force. A previously unappreciated problem in the use of known traction belts is that they tend to apply to the patient a torque which tends to rotate the pelvis in such a way as to bend the small of the back inwardly and thereby apply an undesired force to the spine. It is an object of this invention to provide a belt which will apply an opposite torque which tends to flatten the spine and increase the benefits of the traction force.

A belt according to this invention includes an encircling element adapted to be fastened around a reclining patient. It includes a pull-strap which extends from the back of the belt downward between the legs. The pull-strap is a continuous length of material attached to the encircling element at two points which are spaced longitudinally apart relative to the spine of the wearer. A connector link is slidable along the pull-strap, and its position defines the relative lengths of two arms which extend from it to the two points. The connector link is attachable to a pulling rope so that a pulling force can be exerted on the traction belt.

According to a preferred but optional feature of the invention, a friction-reducing element is carried by the traction belt for reducing the friction between the patient and the bed, so as further to reduce any tendency to exert a torque which tends to curve the spine.

The above and other features of this invention will be fully understood from the following detailed description and the accompanying drawings in which.

Figure 1:
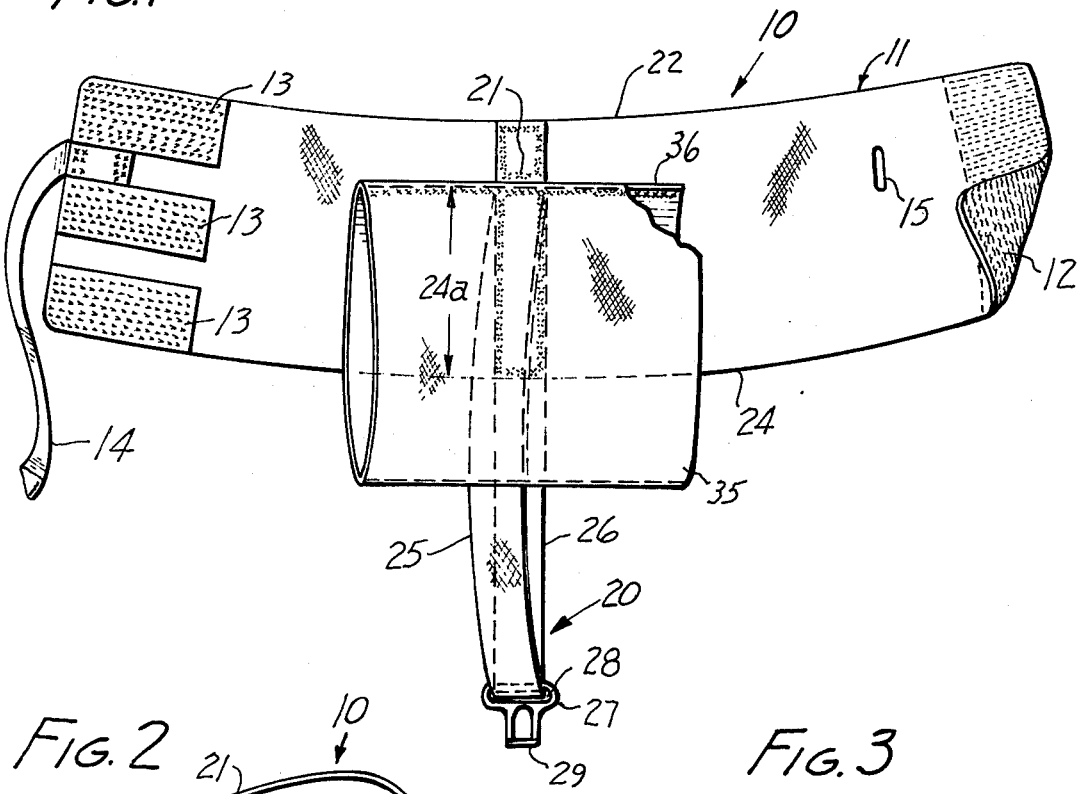
FIG. 1 is a plan view of the outer surface of the belt.

In FIG. 1 a traction belt 10 is shown for use in this invention. It includes a flexible encircling element 11. Element 11 is a generally flat, nearly rectangular, piece of fine canvas. It includes contact adherent fastener means 12, 13 which may be complementary pads of Velcro or other material suited for attaching the ends of the belt together to hold the tightened belt in place by contact adherence.

Figure 2:
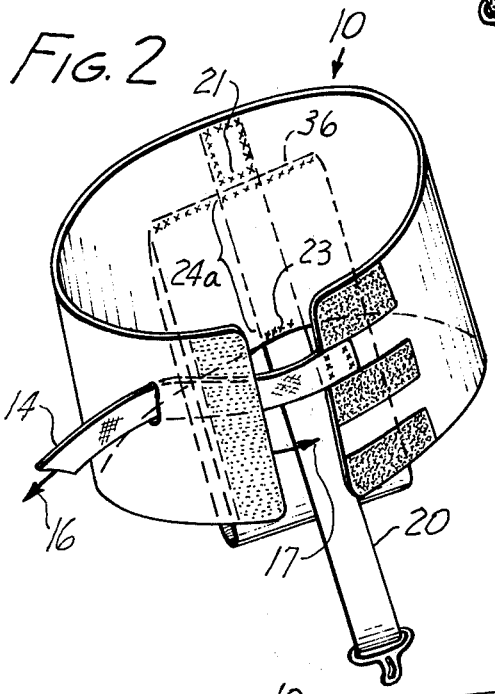
FIG. 2 is a perspective view showing the belt of FIG. 1 being wrapped around the body of a patient.
Figure 3:
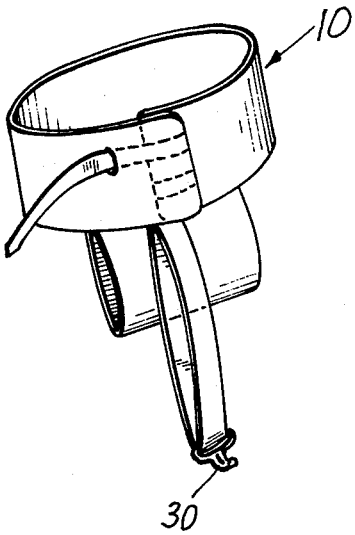
FIG. 3 shows the belt of FIG. 1 fastened around a patient.

Tab 14 is adapted to pass through a slot 15 in the belt for use in tightening the belt as shown by force arrows 16, 17 in FIG. 2. After the belt is tightened around the body of a patient 18, the Velcro elements can be pressed against one another as shown in FIG. 3 to fasten it in place. The patient 18 is shown lying on a bed 19 in FIG. 4.

With further reference to FIG. 1, a pull-strap 20 is shown attached to the outer rear surface of the encircling element. It is joined to the encircling element at two places which, for convenience, are called "points", although it is evident that the points are in fact relatively long stitches or large stitched areas. The first point 21 is near the upper edge 22 of the encircling element, and point 23 is at or near the lower edge 24. Point 21 extends for perhaps one or 2 inches. These points are spaced apart along a longitudinal dimension relative to the spine of the wearer when the belt is worn, and there is a longitudinal spacing 24a where the pull-strap is unattached to the encircling element. The pull-strap is therefore formed as a pair of arms 25, 26. Arm 25 extends from point 21, and arm 26 extends from point 23. The lengths of these arms can vary, as will shortly be seen, as a consequence of the position of a connector link 27 which is slidable along the pull-strap. The pull-strap is flexible, perhaps a piece of flexible material such as canvas webbing or leather, and the connector link includes an eye 28 which encircles the pull-strap so that the connector link can slide along the pull-strap. Attachment means 29 such as an eye-and-hook 30 connect to a traction rope 31 or some other force-exerting means.

As an optional feature of this invention, a friction-reducing element 35 is attached to the rear outer surface of the encircling element, conveniently by a seam 36. The friction-reducing element can be made of two thicknesses of relatively slick material such as fine satin, two faces of which slide across one another with little friction. These thicknesses may be provided by initially forming a tube of the material as shown. When the tube is flattened, thicknesses 37, 38 lie beneath the patient and can readily slide across one another.

Figure 4:
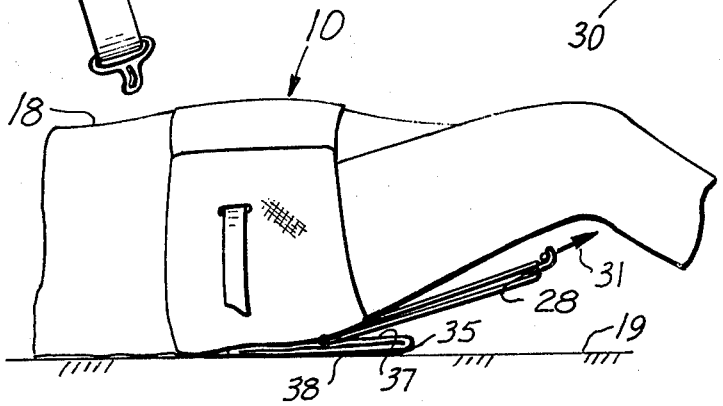
FIG. 4 shows the belt on a reclining patient.
Figure 7:
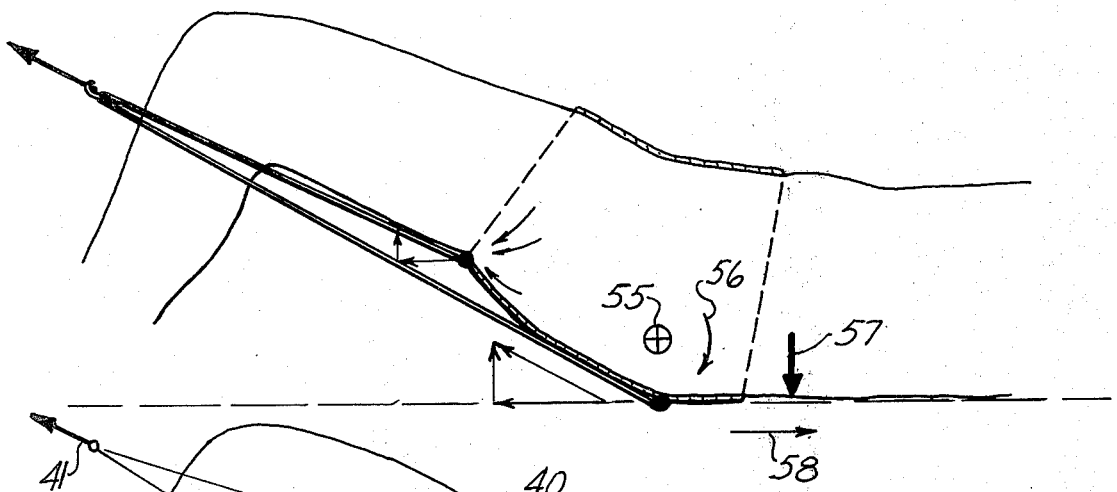
FIG. 7 is a schematic view, partly in cross-section, showing the forces applied to the patient through the belt according to the invention.

In use, the encircling element is wrapped around the patient, the tab 14 is passed through the slot, and then the tab and an end of the encircling element are pulled as shown by arrows 16 and 17 until the belt is as tight as desired, and the Velcro members are then pressed against one another to fasten the belt in place. The patient then lies down on the bed with the pull-strap brought up between his legs as shown in FIGS. 4 and 7. The connector link is attached to the traction rope and traction can begin.

Figure 6:
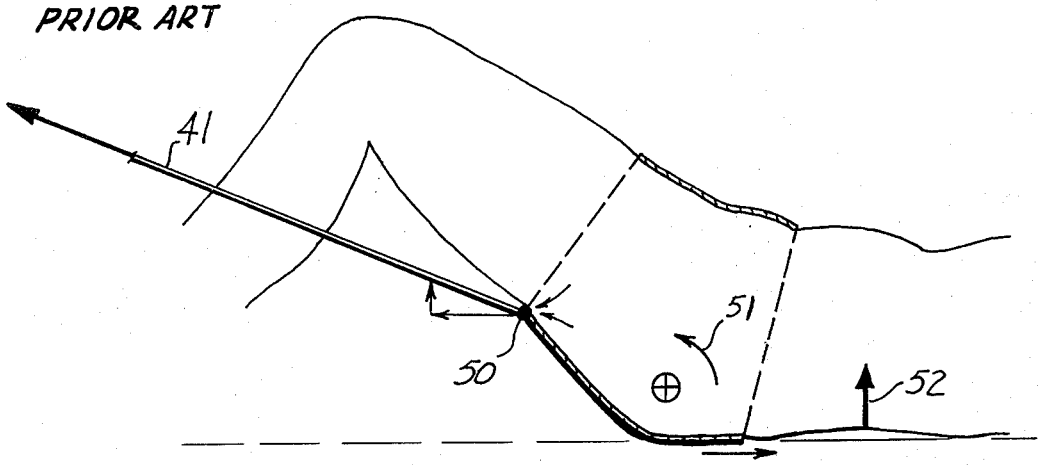
FIG. 6 PRIOR ART
FIGS. 5 and 6 are schematic views showing the forces resulting from the use of prior art belts.
Figure 5:
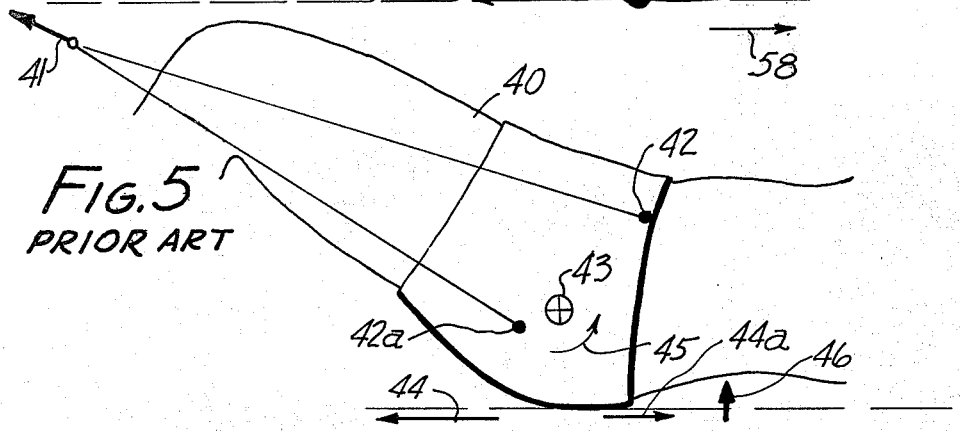
FIG. 5 PRIOR ART

Some of the difficulties inherent in the prior art are best illustrated in FIG. 5 where a patient 40 is shown with one belt according to the prior art wrapped around his torso. In FIG. 5, the pull-straps or traction ropes are attached at both sides of the torso. In FIGS. 4, 6 and 7, the rope and/or pull-strap passes between the legs, the force being exerted at the centerline of the patient (aligned with his spine). This is why the belt is cross-sectioned in FIGS. 6 and 7, but not in FIG. 5.

It is customary in some prior art for the pull rope 41 to be attached at points 42 and **42*a* at the side of the patient. Often two ropes or pull-straps are provided for this purpose. The resultant force relative to the centroid 43 of the patient is shown in FIG. 5 as comprising a pull force 44 to the left, resisted by a friction force 44*a* to the right, together with a torque 45 which is counterclockwise. The torque results in an upward force 46,** tending to curve the small of the back. This is undesirable in traction.

Another prior art device is shown in FIG. 6 where the pull rope 41 is attached to the lower edge of the center of the traction belt at point 50. This connection is made between the legs. Depending on the angle of the rope and the position of the patient, a counterclockwise torque 51 can be generated, which rotates the pelvis and results in upward force 52.

It may be observed here that similar results would be produced in FIGS. 5 and 6 if the traction forces were exerted directly to a leg or legs of the patient.

In contrast, the device of the present invention is shown in FIG. 7, with the pull-strap passing between the legs of the patient. The connector link adjusts the load between the two arms in response to the position of the patient and the direction of the pull, which pull should be upwardly relative to the bed and away from the patient; that is, toward his feet. This divides the force between the two arms. The force components are shown in FIG. 7 relative to centroid 55. The force distribution is such that a clockwise torque 56 results which provides a downward force 57 at the small of the user's back, which flattens his spine while it is being pulled, and thereby improves the therapy.

When the force-reducing element is not used in FIG. 7, there will be a certain amount of friction shown by friction arrow 58 in FIG. 7, which is counter-productive. The result of this friction would be to reduce the traction and the clockwise torque. This can be overcome by the use of the torque-reducing element as shown in FIG. 4, because it interposes a low friction pair of surfaces between the patient and the bed, whereby to reduce the force indicated by arrow 58 and to increase both the useful tractive force and the useful flattening force 57.

This invention is not to be limited by the embodiments shown in the drawings and described in the description, which are given by way of example and not of limitation, but only in accordance with the scope of the appended claims.

I claim:

1. A traction belt for application to the torso of a patient comprising a flexible encircling element, fastener means for fastening the encircling element around the torso, a pull-strap having a pair of arms, each arm being attached to a point on the encircling element, said points being spaced apart from one another so that each arm lies adjacent each other for at least the entire length of the free portion of the shorter of the two arms and along a longitudinal dimension corresponding to the spine of the patient, and a connector link slidably fixed to said pull-strap for exerting a pull thereon and dividing the pull-strap into said pair of arms extending between the connector link and the respective points.

2. A traction belt according to claim 1 in which the encircling element and the pull-strap are flexible.

3. A traction belt according to claim 1 in which the fastener means comprises Velcro.

4. A traction belt according to claim 1 in which there is a substantial longitudinal dimension of the encircling element between said points to which the pull-strap is unattached.

5. A traction belt according to claim 1 in which a material of relatively low coefficient of friction is attached to the belt on the same side thereof as the pull-strap.

6. A traction belt according to claim 5 in which the friction-reducing element comprises a pair of thicknesses of low-friction material.

7. A traction belt according to claim 6 in which the friction-reducing element is a tube of material having a low coefficient of friction.

8. A traction belt according to claim 7 in which the material is satin.

9. A traction belt according to claim 5 in which the encircling element and the pull-strap are flexible.

10. A traction belt according to claim 5 in which the fastener means comprises Velcro.

11. A traction belt according to claim 5 in which there is a substantial longitudinal dimension of the encircling element between said points to which the pull-strap is unattached.

* * * * *